US009820593B2

(12) United States Patent
Adams

(10) Patent No.: US 9,820,593 B2
(45) Date of Patent: Nov. 21, 2017

(54) HEAD SUPPORT SLEEP AID

(71) Applicant: Joseph Michael Adams, Santa Ana, CA (US)

(72) Inventor: Joseph Michael Adams, Santa Ana, CA (US)

( * ) Notice: Subject to any disclaimer, the term of this patent is extended or adjusted under 35 U.S.C. 154(b) by 36 days.

(21) Appl. No.: 14/838,319

(22) Filed: Aug. 27, 2015

(65) Prior Publication Data

US 2016/0066697 A1 Mar. 10, 2016

Related U.S. Application Data

(60) Provisional application No. 62/043,338, filed on Aug. 28, 2014.

(51) Int. Cl.
*A47G 9/10* (2006.01)

(52) U.S. Cl.
CPC ..... *A47G 9/1081* (2013.01); *A47G 9/109* (2013.01); *A47G 2009/1018* (2013.01)

(58) Field of Classification Search
CPC ..... A47G 9/10; A47G 9/1081; A47G 9/109; A47G 2009/1018; A47C 27/146; A47C 27/15
See application file for complete search history.

(56) References Cited

U.S. PATENT DOCUMENTS 3,006,177 A * 10/1961 Holmes ..... C14C 9/00 69/21
5,781,947 A * 7/1998 Sramek ..... A47G 9/10 5/636
5,987,676 A * 11/1999 Littleford ..... A47G 9/10 5/636
6,345,401 B1 * 2/2002 Frydman ..... A47G 9/10 5/636
9,205,014 B1 * 12/2015 Nesley ..... A61G 13/121
9,289,082 B1 * 3/2016 White ..... A47G 9/10
2014/0317851 A1 * 10/2014 Hammack ..... A47G 9/10 5/640
2015/0089743 A1 * 4/2015 Haworth ..... A47G 9/1036 5/640

* cited by examiner

*Primary Examiner* — Nicholas Polito
(74) *Attorney, Agent, or Firm* — Roy A. Ekstrand

(57) ABSTRACT

A plurality of interlocking stackable foam pillow segments together with a head and neck support and an elongated generally cylindrical resilient neck support member. The pillow segments are generally rectangular defining interlocking members which facilitate the stacking and interlock of the pillow segments in a vertical stack. The head and neck support defines a pillow resting surface and a head resting surface. The head resting surface further defines an ear clearance cavity surrounded by a face support surface. The head and neck support further includes a flexible mesh fabric ear coupling having an outer edge joined to and surrounding the face support surface and encircling the ear-receiving cavity. The ear-receiving cavity is sized to receive the user's ear into the ear coupling and is elastically constricted to close upon the user's ear between the ear and head surface to captivate the ear.

11 Claims, 8 Drawing Sheets

HEAD SUPPORT SLEEP AID

CROSS-REFERENCE TO RELATED APPLICATION

This application claims the benefit of and priority under 35 U.S.C. 119(e) of U.S. Provisional Patent Application Ser. No. 62/043,338 entitled HEAD SUPPORT SLEEP AID, filed Aug. 28, 2014 in the name of Joseph Michael Adams, the disclosure of which is incorporated herein by reference.

FIELD OF THE INVENTION

This invention relates generally to sleep aids and particularly to head rests.

BACKGROUND OF THE INVENTION

Most people within the United States of America and other similar industrialized nations sleep with one or more pillows upon a supportive but generally soft and hopefully comfortable mattress. While the fabrication of pillows varies substantially, many provide a closed cloth fabric envelope within which a soft and sometimes resilient material such as foam material is confined. Still other types of pillows utilize material such as feathers or shredded resilient foam to provide the desired sleeping comfort. Still other pillows comprise a solid generally rectangular unitary block of resilient foam material utilizing plastic or rubber foam.

While the preferred sleeping position varies substantially, a great majority people tend to sleep on one side or the other rather than face down or face up. Typically, sleepers prefer to lie on one side or the other with one or more pillows positioned beneath the head and neck. The sleeper usually rests their head and side face upon the pillow surface. The general overall objective among sleepers in this sleeping posture is to compensate for the difference in elevation from the bed surface between the sleepers shoulder and neck. Simply stated, the centered positioned of a person's neck raises the person's neck and head away from the bed surface when the person is lying upon their side. One or more pillows are positioned beneath the neck and head to fill the difference of elevation between the neck and head and shoulder. Thus, the pillow is intended to support the weight of the user's head and neck and provide a general alignment between the user's neck and the user's spine.

During the sleep cycle, people naturally move and change positions from time to time even while remaining asleep. This movement is to some extent a natural process and is probably intended to minimize the overall stress upon muscles and joints which would otherwise occur if the sleeper remained in a single fixed position all night. While the movement and change of positions is a natural part of the sleep cycle, there are unfortunate consequences which arise. When using conventional pillows, the user is likely to move upon the pillows and thus change the elevation of the user's head and thereby the alignment of neck and spine. In addition, the use of more than one pillow provides an undesired change in neck and spine alignment as the pillows tend to slide upon each other thereby changing neck and spine alignment. Thus, the use of one or more conventional pillows often leads to sleeping in an awkward position in which neck and spine alignment is less than desirable.

In addition to the potential misalignment of neck and spine resulting from the use of conventional pillows for persons tending to sleep on their sides, the interaction between the skin of the sleepers face and the surface of the pillow or pillows imposes a further problem upon the sleeper. It has been shown that sleeping upon a pillow in a side rest position places the skin of the sleepers face against the pillows surface in a manner which tends to stress, stretch and often wrinkle the sleeper's skin. The undesired wrinkling of skin on the side of the user's face, particularly in the skin portion proximate to the eye has been shown to increase and accelerate the establishment of permanent skin wrinkling, particularly around the eye. The familiar aging effect produced by wrinkles upon the face and eye region is a well-known effect as a person ages. Unfortunately, the skin wrinkling resulting from sleeping upon the typical pillow or pillows used today has been found to accelerate and exacerbate this condition. Within modern society, excessive eye wrinkling is seen as advanced age. Thus, skin wrinkling about the face and eye gives the person an appearance of advanced age. For the most part, this is undesirable and in some instance unacceptable.

Thus, for most people careful attention to body and head positioning prior to going to sleep is not effective due to the natural movement and motion mentioned above. Persons may pay attention to the position selected for sleeping as they wait to fall asleep. However, during the sleep cycle, substantial movement can result in skin wrinkling and loss of neck and spine alignment. One of the most important phases of the sleep cycle during a typical night sleep is referred to as REM (rapid eye movement). Studies directed toward the sleep cycle have determined that the phase of sleep during which the sleeping persons eyes are found to move rapidly to and fro is believed to be the most important and restorative phase of a night sleep. Characteristically, it has been found that individuals do not move significantly during the majority of REM sleep. Ironically, while the REM sleep and its lack of movement maximize the benefits of the sleep cycle, the lack of movement may also exacerbate the skin wrinkling and maintenance of a poorly designed neck and spine for a long period of time. As a result, the user may awake with some neck stiffness and muscle soreness and a skin wrinkling effect.

In response to the problems and limitations characteristic of conventional pillows, practitioners in the art have endeavored to provide pillows which enhance neck and spine alignment and which reduce skin wrinkling effects. Unfortunately, while such attempts are well intentioned, they have thus is far proven to be ineffective. Sleepers utilizing such devices continue to move and disturb the desired position. Practitioners have employed pillows of various contours which have been found ineffective and often exacerbate the problem due to the effect of the various contours upon the user's head and neck and facial skin as the user moves during the night. Thus, despite substantial efforts by practitioners in the art, their continues to exist an unresolved need for a more effective, efficient, low-cost and comfortable sleep aid which maintains neck and spine alignment and which avoids undue wrinkling or stressing of the sleepers skin.

SUMMARY OF THE INVENTION

Accordingly, it is a general object of the present invention to provide and improved head support sleep aid. It is a more particular object of the present invention to provide an improved head support sleep aid which maintains correct alignment of the user's neck and spine. It is a still more particular object of the present invention to provide an improved head support sleep aid which supports the user's head in a manner which avoids undue wrinkling of the user's face particularly in the skin areas proximate the user's eye. It is a still further object of the present invention to provide an improved head support sleep aid which maintains the appropriate head support during movement as the user sleeps.

The present invention provides a plurality of interlocking stackable foam pillow segments together with a head and neck support and an elongated generally cylindrical resilient neck support member. The pillow segments are generally rectangular defining interlocking members which facilitate the stacking and interlock of the pillow segments in a vertical stack. The head and neck support defines a pillow resting surface and a head resting surface. The head resting surface further defines an ear clearance cavity surrounded by a face support surface. The head and neck support further includes a flexible mesh fabric ear coupling having an outer edge joined to and surrounding the face support surface and encircling the ear-receiving cavity. The ear-receiving cavity is sized to receive the user's ear into the ear coupling and is elastically constricted to close upon the user's ear between the ear and head surface to captivate the ear.

In operation, the user selects the number of interlocking stackable pillow segments to suit the pillow thickness desired. The user then positions the head and neck support upon the upper surface of the upper most pillow segment. The user then lies upon the bed resting the user's head upon the head and neck support while inserting the user's ear within the mesh ear coupling and positioning such that the user's ear extends into the ear clearance cavity. The elastic constriction about the ear maintains the position of the head and neck support against the user's head and maintains the desired position such that the user's head is supported such that the facial skin particularly in and around the eye region is free of contact with the head and neck support. During sleep, the head position is maintained due to the captivity of the user's ear which maintains proper positioning of the head supporting surface between the user's ear and facial skin. As a result, neck and spine alignment is maintained while wrinkling or stress of facial skin in and around the user's eye region is avoided.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

By way of overview, the present invention provides an improved head support sleep aid. The improved head support sleep aid maintains correct alignment of the user's neck and spine. The improved head support sleep aid supports the user's head in a manner which avoids undue wrinkling of the user's face particularly in the skin areas proximate the user's eye. The improved head support sleep aid maintains the appropriate head support during movement as the user sleeps.

Figure 1:
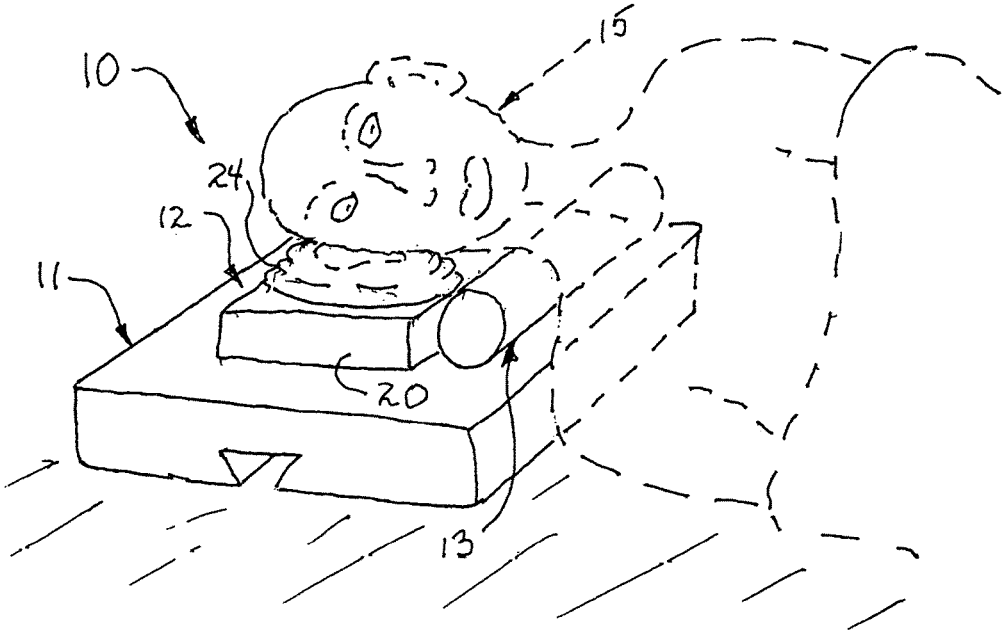
FIG. 1 sets forth a perspective view of the present invention head support sleep aid illustrating the position of a user.

More specifically, FIG. 1 sets forth a perspective view of a head support and sleep aid constructed in accordance with the present invention and generally referenced by numeral 10. Head support and sleep aid 10 is shown being utilized by a sleeping person generally referenced by numeral 15 in a typical anticipated use of the invention. Head support sleep aid 10 includes a generally rectangular segment 11 preferably fabricated of a resilient foam material such as rubber or plastic. Head support sleep aid 10 further includes a head and neck support 12 having a generally rectangular resilient foam body 20. As is described below in greater detail, head and neck support 12 further includes a flexible mesh ear coupling 24 which, in the manner described below, is secured to foam body 20. In further accordance with the fabrication of ear coupling 24, sleeping person 15 is resting upon foam body 20 and has a lower ear extending into and received within ear coupling 24. An elongated cylindrical preferably resilient foam material neck support 13 is positioned upon pillow segment 11 beneath the neck portion of sleeping person 15.

In accordance with the anticipated use of the present invention head support sleep aid, sleeping person 15 is resting upon the combined structures provided by pillow segment 11 and head and neck support 12. Both of these structures are preferably formed of a resilient foam material and thus provide a cushioning support. In further accordance with the anticipated use of the present invention head support and sleep aid, sleeping person 15 is resting the side portion of the users head upon ear coupling 24 and head resting surface 21 of foam body 20. Thus, the weight of the head and neck portion of sleeping person 15 is resting upon and "crumples" ear coupling 24. With temporary reference to FIG. 4, it will be noted that foam body 20 of head and neck support 12 defines an ear clearance cavity 22 which extends downwardly from head resting surface 21. Thus, the user in the posture shown in FIG. 1 has inserted the user's ear through ear aperture 26 of ear coupling 24. As a result, the user in resting the user's head upon surface 21 of foam body 20 collapses or crumples ear coupling 24 allowing the user's ear to extend downwardly into ear clearance cavity 22. In this manner, the surrounding portion of head resting surface 21 supports the head of sleeping person 15 without imposing stress or pressure or wrinkling upon the facial portions of sleeping person 15 in the eye and surrounding regions. As a result, person 15 is able to sleep resting upon head support and sleep aid 10 while ear coupling 24 maintains the correct position between the sleeping persons head and foam body 20. Neck support 13 provides additional foam support for the neck portion of the user. As a result, as sleeping person 15 shifts and moves during the sleep cycle, the captivity of user's ear within ear coupling 24 is maintained which in turn maintains the correct position of head and neck support 12.

Figure 2:
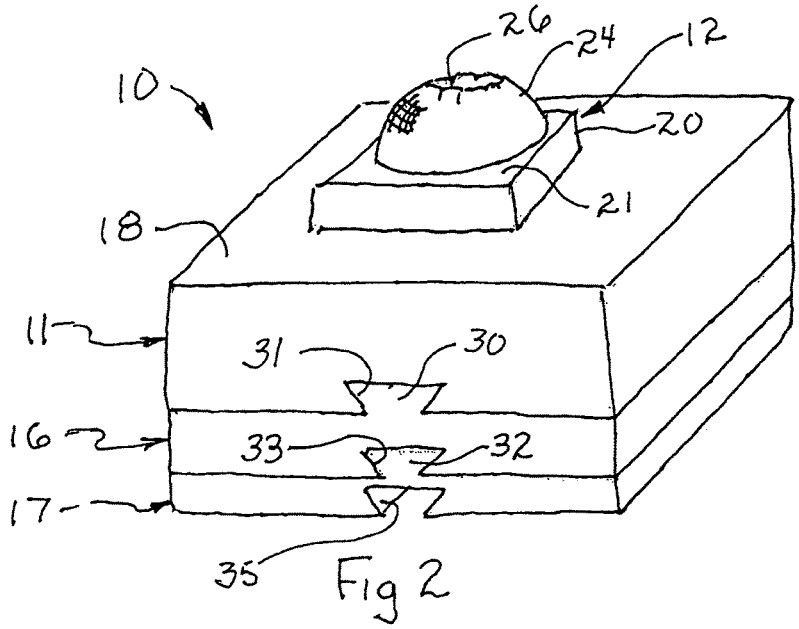
FIG. 2 sets forth a perspective view of the present invention head support sleep aid.

FIG. 2 sets forth a perspective assembly of head support sleep aid 10 in its entirety. In accordance with the preferred fabrication of the present invention, head support sleep aid 10 includes a plurality of interlocking stackable pillow segments 11, 16 and 17. In further accordance with the preferred fabrication of the present invention, pillow segments 11, 16 and 17 form generally rectangular resilient foam plastic or rubber bodies which define different thicknesses or heights. Thus, in the illustration of the present invention shown in FIG. 2, pillow segment 11 is the thickest pillow segment while pillow segment 17 forms the thinnest pillow segment and pillow segment 16 defines an intermediate or medium thickness or height. Pillow segment 11 defines a top surface 18 and further defines an interlock receptacle 31. Pillow segment 16 defines an interlock receptacle 33 together with an upwardly extending interlock 30. Finally, pillow segment 17 defines an interlock receptacle 35 and an interlock 32. In the stack configuration shown in FIG. 2, pillow segment 11 is resting upon pillow segment 16 and is maintained in attachment by the insertion of interlock 30 of pillow segment 16 into interlock receptacle 31. Similarly, pillow segment 16 is resting upon pillow segment 17 and is maintained in position by the insertion of interlock 32 of pillow segment 17 into interlock receptacle 33 of pillow segment 16. It will be apparent to those skilled in the art that different pillow thickness may be obtained by utilizing different combinations of pillow segments. For example, it will be apparent to those skilled in the art that the combined thickness of head support sleep aid 10 may be altered by removing pillow segment 16 and securing pillow segment 17 directly to pillow segment 11. Similarly, as set forth above in FIG. 1, the thickness of the resulting pillow may be further altered by simply using pillow segment 11 alone. Finally, pillow segments 16 and 11 may be utilized while omitting pillow segment 17 and so on. It will be equally apparent to those skilled in the art that while three pillow segments are shown in the embodiment illustrated in FIG. 2, a different number of pillow segments with different thickness relationships may be utilized without departing from the spirit and scope of the present invention. The important aspect of the illustration shown in FIG. 2 is the provision of a selected pillow thickness which is maintained despite movement on the part of the user by the interlocking feature.

As described above, head support and sleep aid 10 also includes head and neck support 12 which includes a generally rectangular foam body 20 having a head resting surface 21. As is also described above, head and neck support 12 includes a flexible mesh material ear coupling 24 secured to surface 21 and having an elastically constricted ear-receiving aperture 26. While the embodiment show utilizes an elastic constricture, such as an elastic band, for aperture 26, other closures may be used. For example, aperture 26 may be closed using a sliding bead drawstring, a rubber band, a snap attachment, a button attachment or a hook and loop fabric attachment. It will also be apparent to those skilled in the art that foam body 20 may be formed of other materials such as cotton, pressed fabric or the like without departing from the spirit and scope of the present invention. Similarly, the shape of foam body 20 may be formed in a variety of different shapes, including but not limited to circular, oval, pear, horse shoe, kidney bean or heart-shaped. By way of further variation, ear coupler 24 may be formed of various materials, such as cotton, molded plastic or woven fabric without departing from the spirit and scope of the present invention.

Figure 3:
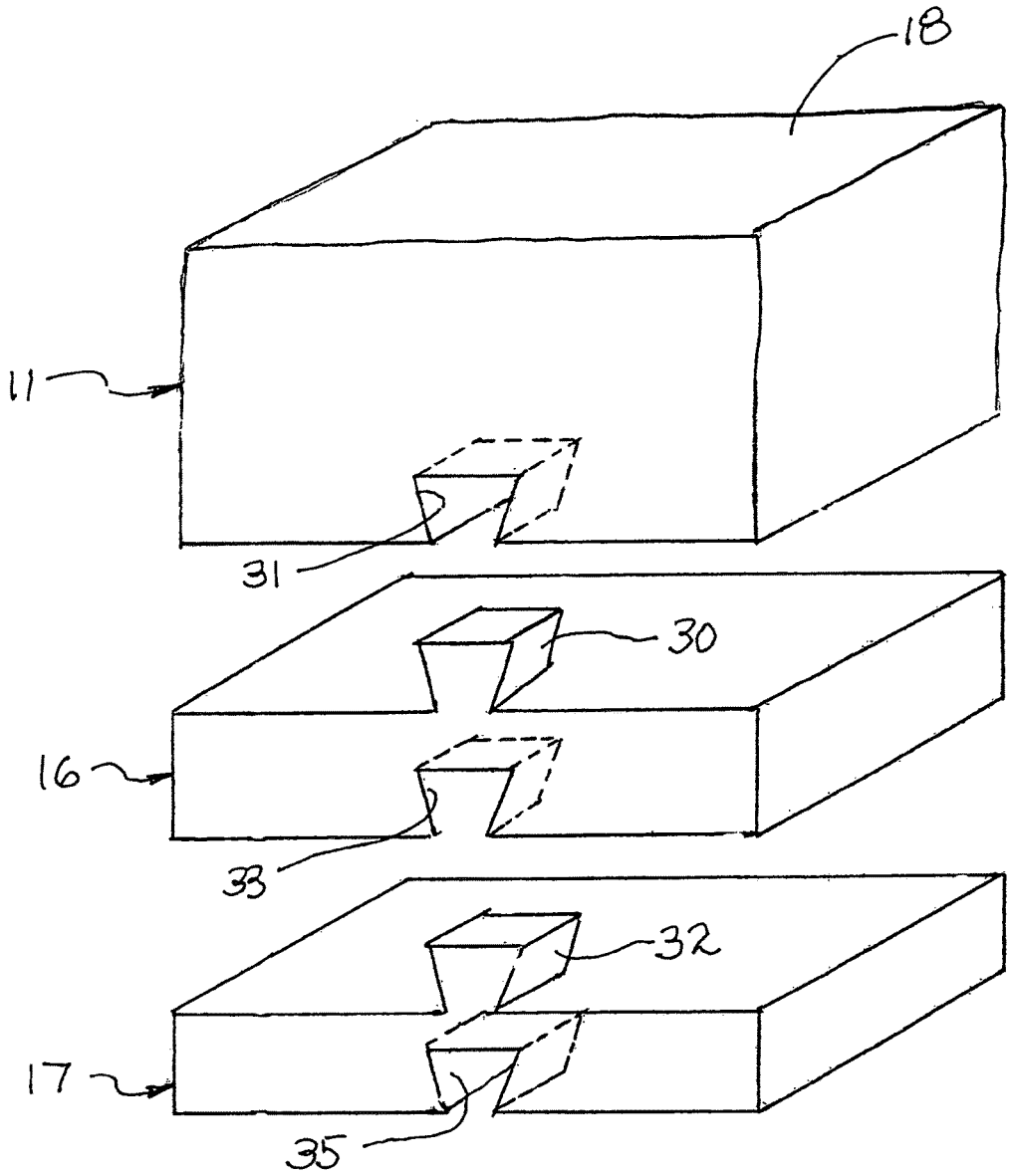
FIG. 3 sets forth a perspective exploded view of the stackable interlocking pillow segments of the present invention head support sleep aid.

FIG. 3 sets forth a perspective assembly view of the interlocking pillow segments utilized in the present invention head support sleep aid. As described above, pillow segment 11 defines an interlock receptacle 31 and an upper surface 18. As is also described, pillow segment 16 defines an interlock receptacle 33 and an upwardly extending interlock 30. Finally, pillow segment 17 defines an interlock receptacle 35 and an upwardly extending interlock 32. It will be apparent to those skilled in the art that the configurations of interlocks 30 and 32 as well as interlock receptacles 31, 33 and 35 facilitate mutual intercoupling and attachment. Thus, it will be apparent that interlock 30 may be received within interlock receptacle 31 while interlock 32 may be received within either interlock receptacle 31 or interlock receptacle 33. In this manner, the combined height may be selectively determined by utilizing either a single pillow segment or a plurality of pillow segments which have been stacked and interlocked. The interlock feature facilitates the use of multiple pillow segments in a fixed stacked arrangement despite movement of the user during sleep. In the preferred fabrication of the present invention, pillow segments 11, 16 and 17 are fabricated of a resilient somewhat firm material such as foam plastic or foam rubber or the like.

Figure 4:
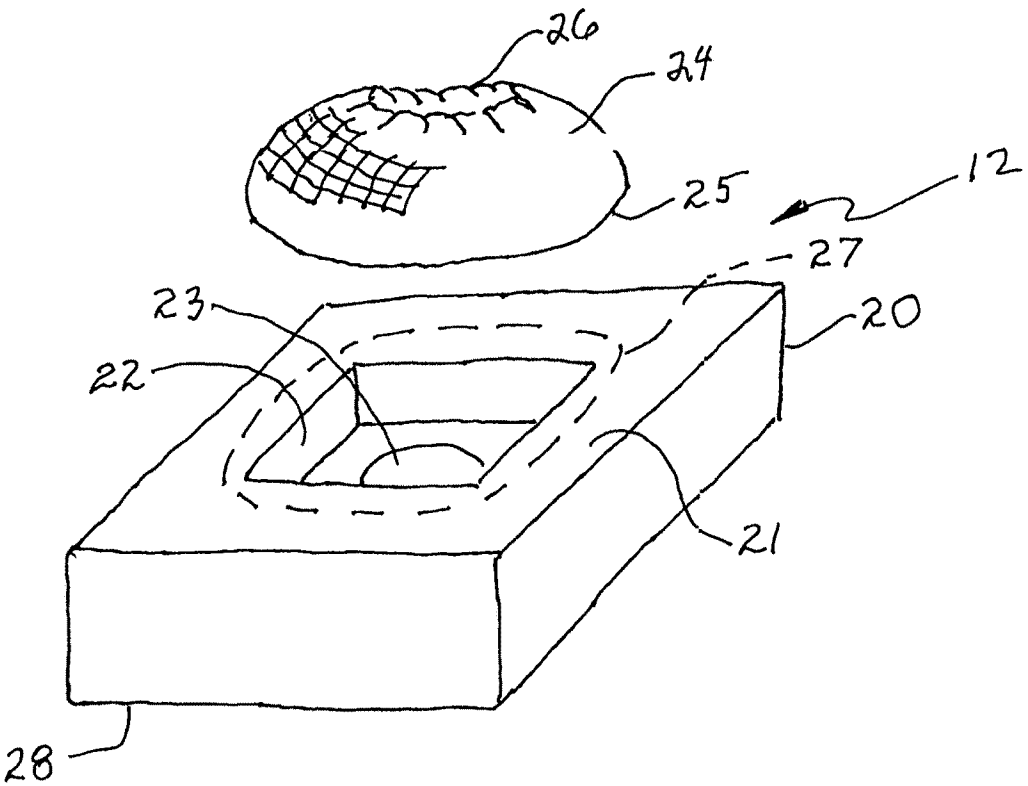
FIG. 4 sets forth a perspective assembly view of the head and neck support portion of the present invention head support sleep aid.

FIG. 4 sets forth a perspective assembly view of head and neck support 12 which, as is described above, includes a generally rectangular foam body 20 defining a head resting surface 21 and a pillow resting surface 28. As can be seen in FIGS. 1 and 2 above, pillow resting surface 28 generally conforms to the planar upper surface of pillow segments such as pillow segment 11 allowing foam body 20 to rest upon the underlying pillow segment. Head resting surface 21 further defines a downwardly extending ear clearance cavity 22 together with a further downwardly extending clearance aperture 23. Head and neck support 12 further includes a flexible mesh material ear coupling 24. Ear coupling 24 defines a bottom edge 25 which is positioned upon head resting surface 21 of foam body 20 so as to enclose ear clearance cavity 22 and as is indicated by dashed line 27. Edge 25 may be joined to head resting surface 21 using virtually any conventional fabrication technique such as adhesive attachment or chemical or sonic welding as desired. Ear coupling 24 further includes an ear receiving aperture 26 which is sufficient in size to allow a typical users ear to be passed there through. In the preferred fabrication of the present invention, ear-receiving aperture 26 is elastically constricted by an elastic material which draws ear-receiving aperture 26 to a semi-closed configuration. In this manner, an ear passed through aperture 26 is gripped loosely within the interior of ear coupling 24 and maintained by the constrictor of aperture 26. This maintains the position of head and neck support against the user's face and avoids resting the user's facial skin against foam body 20 in the portions thereof surrounding the user's eye. The constricting character of aperture 26 maintains the user's ear in a loose attachment to ear coupling 24 and thus maintains the appropriate head positioning for the user.

Figure 5:
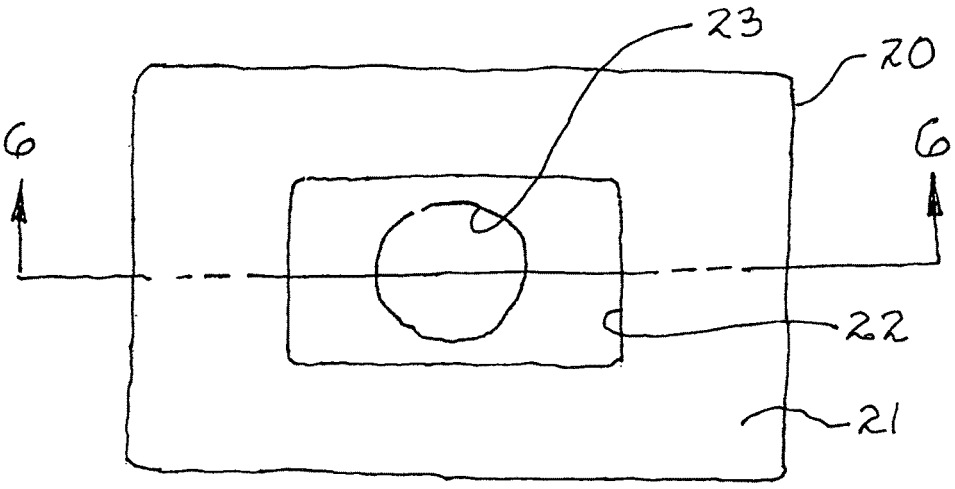
FIG. 5 sets forth a top view of the head and neck support section shown in FIG. 4.

FIG. 5 sets forth a top view of foam body 20 utilized in head and neck support 12. Foam body 20 defines a head resting surface 21 and an ear clearance cavity 22. Within cavity 22, a clearance aperture 23 extends downwardly through the remainder of foam body 20.

Figure 6:
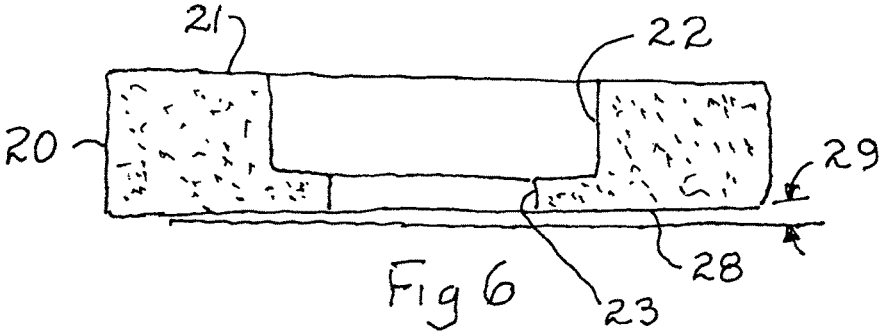
FIG. 6 sets forth a section view of the head and neck support taken along section lines 6-6 in FIG. 5.

FIG. 6 sets forth a section view of foam body 20 taken along section lines 6-6 in FIG. 5. As described above, foam body 20 defines a head rest surface 21 together with a clearance cavity 22 and a clearance aperture 23. Foam body 20 further defines a surface 28 which, in the anticipated use of the present invention, is rested upon an underlying pillow segment in the manner shown in FIG. 1.

Figure 7:
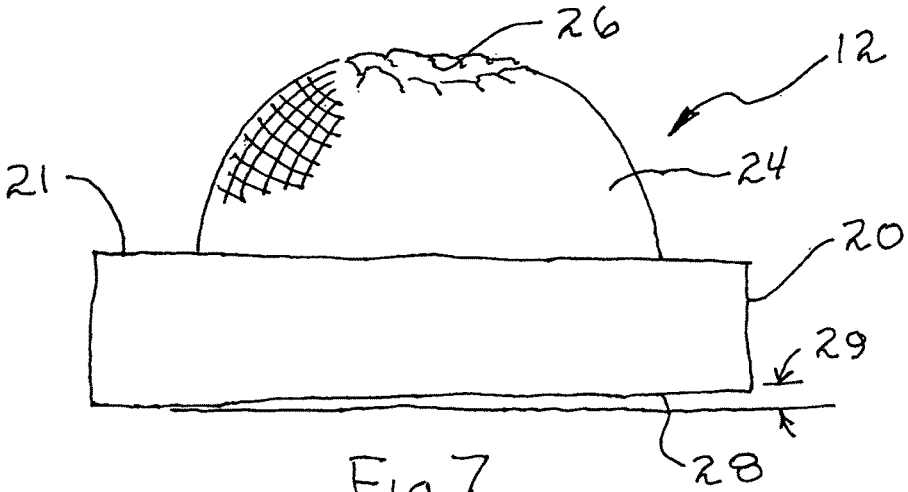
FIG. 7 sets forth a side elevation view of the head and neck support of the present invention head support sleep aid.

FIG. 7 sets forth a side elevation view of head and neck support 12. As described above, head and neck support 12 includes a generally rectangular foam body 20 defining a head rest surface 21 and a pillow rest surface 28. As is also described above, a flexible mesh material ear coupling 24 extends upwardly from surface 21 and terminates an elastically constricted aperture 26. In accordance with the preferred fabrication of the present invention, the generally rectangular shape of foam body 20 is altered slightly by a front to back taper of surface 28. Thus, surface 28 is angled slightly with respect to surface 21 producing a dimensional difference 29 at the rear portion of foam body 20. This front-to-back taper aids in maintaining the correct position of head and neck support 12.

Figure 8:
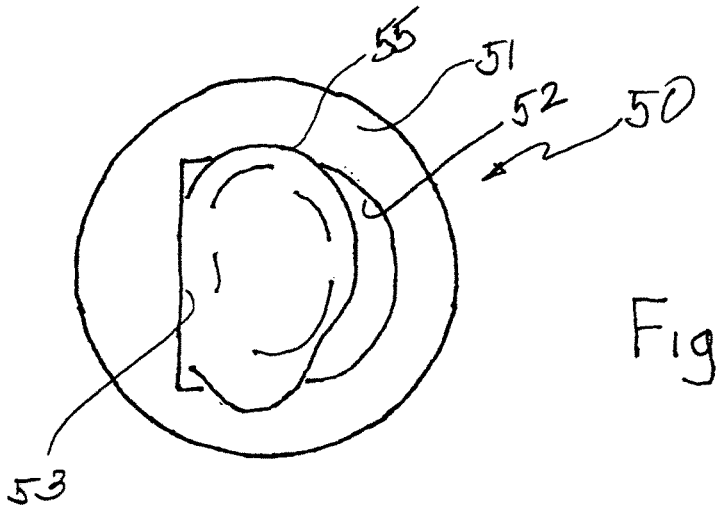
FIG. 8 sets forth a top view of an alternate embodiment earpiece of the present invention head support sleep aid.

FIG. 8 sets forth a top view of an alternate embodiment earpiece of the present invention head support sleep aid generally referenced by numeral 50. Earpiece 50 is formed of a resilient soft material such as foam plastic or foam rubber. As can be seen in FIG. 8, earpiece 50 defines a generally round shaped body 51 which, in turn, defines an aperture 52. Aperture 52 also defines an edge 53 along its frontal end. In accordance with the present invention, earpiece 50 is show in position upon a typical ear 55. In operation, the user places earpiece 50 upon ear 55 as shown to couple the earpiece to the user's hear (not shown). During sleep, earpiece 50 bears a portion of the user's weight and avoids wrinkling of the user's facial skin.

Figure 9:
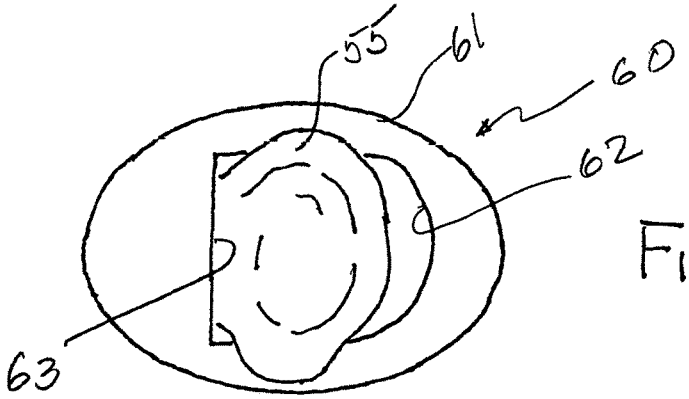
FIG. 9 sets forth a top view of a further alternate embodiment earpiece of the present invention head support sleep aid.

FIG. 9 sets forth a top view of a further alternate embodiment earpiece of the present invention head support sleep aid generally referenced by numeral 60. Earpiece 60 is similar to earpiece 50, described above in that it includes a soft resilient body 61 defining an aperture 62 and an edge 63. Earpiece 60 operates in the same manner as earpiece 50.

Figure 10:
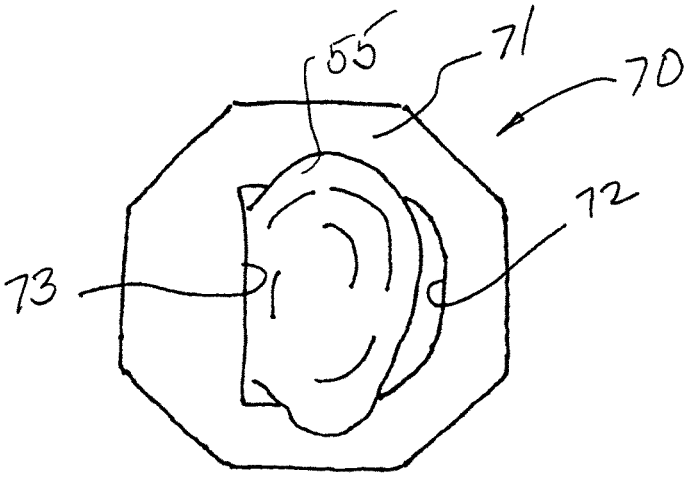
FIG. 10 sets forth a top view of a still further alternate embodiment earpiece of the present invention head support sleep aid.

FIG. 10 sets forth a top view of a still further alternate embodiment earpiece of the present invention head support sleep aid generally referenced by numeral 70. Earpiece 70 is similar to earpiece 50, described above in that it includes a soft resilient body 71 defining an aperture 72 and an edge 73. Earpiece 70 operates in the same manner as earpiece 50.

Earpieces 50, 60 and 70 are shown to provide alternative earpiece shapes, all functioning in the same manner. Thus, it will be apparent to those skilled in the art that earpieces having further alternate shapes may be used without departing from the spirit and scope of the present invention. It will be further apparent that a plurality of soft flexible ties (not shown) may be added to the above earpieces to tie them to the user's head as desired.

Figure 11:
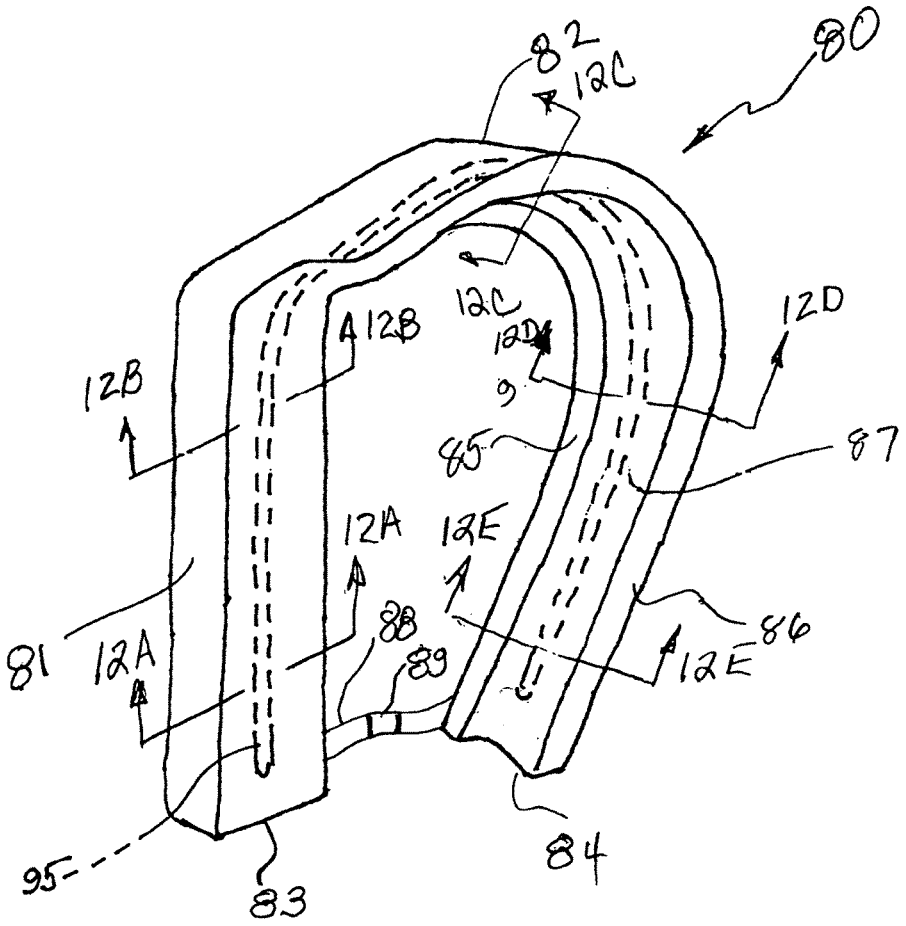
FIG. 11 sets forth a perspective view of a still further alternate embodiment earpiece of the present invention head support sleep aid.

FIG. 11 sets forth a perspective view of a still further alternate embodiment earpiece of the present invention head support sleep aid generally referenced by numeral 80. Earpiece 80 is preferably formed of a soft resilient material, such as molded foam rubber or molded foam plastic. Earpiece 80 includes an elongated, generally planar frontal pad 81 joined to a curved bridge 82, Bridge 82 curves downwardly to an end 84. Bridge 82 also fines an edge 85 and an edge 86 together with a concave curved surface 87. Frontal pad 81 further defines a flexible tie 88 extending from end 83 to end 84. A clasp, such as a hook and loop fabric attachment pad 89 allows tie 88 to be separatable. In operation, the user places earpiece 80 upon the user's ear 55 as shown below in FIG. 13. To couple the earpiece to the user's hear (not shown), clasp 89 is released and earpiece 80 is placed upon user's ear 55 (shown in FIG. 13). Thereafter, tie 88 is drawn and clasp 89 secures earpiece 80 in place. A malleable reinforcing wire 95 is molded into earpiece 80 to aid in forming the earpiece to the user's ear and head for greater comfort. During sleep, earpiece 80 bears a portion of the user's weight and avoids wrinkling of the user's facial skin.

Figure 12A:
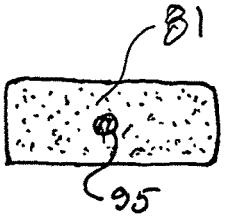
FIG. 12A sets forth a section view of the alternate embodiment earpiece of the present invention head support sleep aid set forth in FIG. 11 taken along section line 12A-12A therein.

FIG. 12A sets forth a section view of the alternate embodiment earpiece of the present invention head support sleep aid set forth in FIG. 11 taken along section line 12A-12A therein.

Figure 12B:
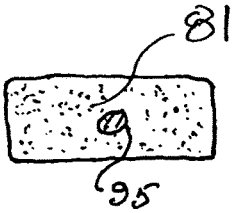
FIG. 12B sets forth a section view of the alternate embodiment earpiece of the present invention head support sleep aid set forth in FIG. 11 taken along section line 12B-12B therein.

FIG. 12B sets forth a section view of the alternate embodiment earpiece of the present invention head support sleep aid set forth in FIG. 11 taken along section line 12B-12B therein.

Figure 12C:
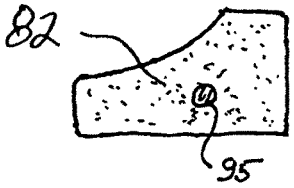
FIG. 12C sets forth a section view of the alternate embodiment earpiece of the present invention head support sleep aid set forth in FIG. 11 taken along section line 12C-12C therein.

FIG. 12C sets forth a section view of the alternate embodiment earpiece of the present invention head support sleep aid set forth in FIG. 11 taken along section line 12C-12C therein.

Figure 12D:
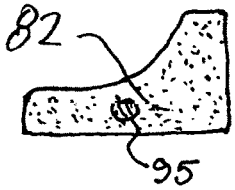
FIG. 12D sets forth a section view of the alternate embodiment earpiece of the present invention head support sleep aid set forth in FIG. 11 taken along section line 12D-12D therein.

FIG. 12D sets forth a section view of the alternate embodiment earpiece of the present invention head support sleep aid set forth in FIG. 11 taken along section line 12D-12D therein.

Figure 12E:
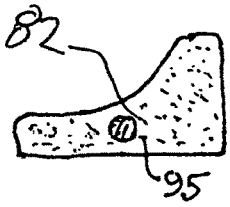
FIG. 12E sets forth a section view of the alternate embodiment earpiece of the present invention head support sleep aid set forth in FIG. 11 taken along section line 12E-12E therein.
Figure 13:
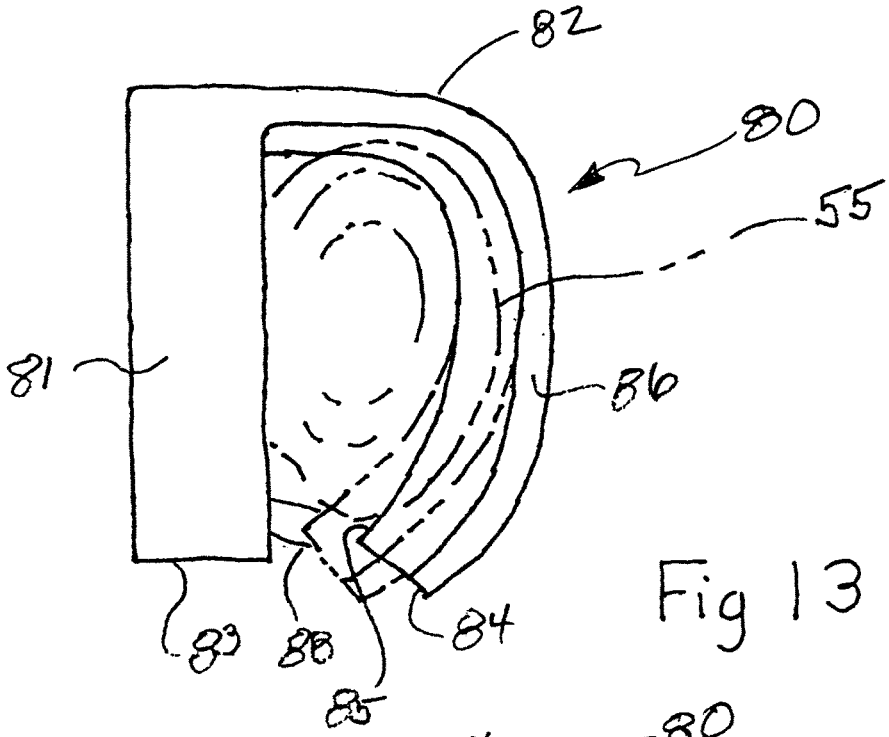
FIG. 13 sets forth a top view of the alternate embodiment earpiece of the present invention head support sleep aid shown in FIG. 11 fitted to a user's ear.

FIG. 12E sets forth a section view of the alternate embodiment earpiece of the present invention head support sleep aid set forth in FIG. 11 taken along section line 12E-12E therein;

FIG. 13 sets forth a top view of earpiece 80 fitted to a user's ear 55. As described above, earpiece 80 is preferably formed of a soft resilient material, such as molded foam rubber or molded foam plastic. Earpiece 80 includes an elongated, generally planar frontal pad 81 joined to a curved bridge 82, Bridge 82 curves downwardly to an end 84. Bridge 82 also fines an edge 85 and an edge 86 together with a concave curved surface 87. Frontal pad 81 further defines a flexible tie 88 extending from end 83 to end 84. A clasp, such as a hook and loop fabric attachment pad 89 allows tie 88 to be separatable. In operation, the user places earpiece 80 upon the user's ear 55. To couple the earpiece to the user's head (not shown), clasp 89 (seen in FIG. 11) is released and earpiece 80 is placed upon user's ear 55 as is shown in FIG. 13. Thereafter, tie 88 is drawn and clasp 89 secures earpiece 80 in place. During sleep, earpiece 80 bears a portion of the user's weight and avoids wrinkling of the user's facial skin. In phantom like depiction, the adjustable position of end 84 to be either closer to end 83 or farther from end 83 is also shown in the figure.

Figure 14:
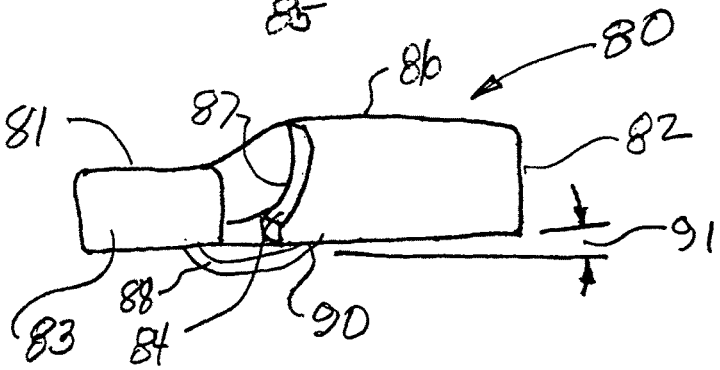
FIG. 14 sets forth a side view of the alternate embodiment earpiece of the present invention head support sleep aid shown in FIG. 11.

FIG. 14 sets forth a side view of earpiece 80. As described above, earpiece 80 is preferably formed of a soft resilient material, such as molded foam rubber or molded foam plastic. Earpiece 80 includes an elongated, generally planar frontal pad 81 joined to a curved bridge 82, Bridge 82 curves downwardly to an end 84. Bridge 82 also fines an edge 86 together with a concave curved surface 87. Frontal pad 81 further defines a flexible tie 88 extending from end 83 to end 84. A clasp, such as a hook and loop fabric attachment pad 89 allows tie 88 to be separatable. earpiece 80 also defines a bottom surface 90 which is tapered to define a reduced thickness away from frontal pad 81. Thus a small taper angle 91 is formed to aid in positioning the user's head during sleep.

What has been shown is a head support sleep aid which provides a plurality of interlocking pillow segments together with a head and neck support which couples to the user's ear. The resulting head support sleep aid avoids applying wrinkles and stress to the facial skin area of the user in an about the user's eye.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A head support sleep aid comprising;

a plurality of pillows having mutually interlocking pillow attachments allowing said pillows to be stacked in an interlocked array with the top pillow defining an upper pillow surface;

a head support positioned upon said upper pillow surface, said head support defining an ear clearance cavity; and an ear coupling joined to said head support having an ear receiving aperture, said ear-receiving aperture being elastically constricted to close upon the user's ear between the ear and head surface to captivate the ear and attach said head support to the user's ear;

said ear receiving aperture allowing a user to insert an ear into said ear coupling and rest upon said head support, and said pillows without stressing or wrinkling the user's facial skin.

2. The head support sleep aid set forth in claim 1 wherein said ear coupling is formed of a soft flexible material.

3. The head support sleep aid set forth in claim 2 wherein said ear coupling is formed of a soft flexible mesh material.

4. The head support sleep aid set forth in claim 3 wherein said head support and said plurality of pillows are formed of a soft resilient foam material.

5. The head support sleep aid set forth in claim 4 wherein said soft resilient foam material includes foam plastic.

6. The head support sleep aid set forth in claim 4 wherein said soft resilient foam material includes foam rubber.

7. A head support sleep aid comprising:

a pillow defining an upper pillow surface;

an earpiece positioned upon said upper pillow surface, said earpiece defining a generally U-shaped member having an elongated generally planar frontal pad defining a bottom end and a top portion and a curved bridge extending from said top portion and curving downwardly to a lower end, said curved bridge being spaced from said frontal pad to define an ear-receiving cavity sized to receive a user's ear and constrictable to close upon a user's ear between the ear and head surface to captivate the ear and facilitate partial encirclement of and attachment to a user's ear;

and a tie extending between said bottom end and said lower end, said earpiece allowing a user to insert an ear into said earpiece and rest upon said earpiece and said pillow without stressing or wrinkling the user's facial skin.

8. The head support sleep aid set forth in claim 7 wherein said curved bridge defines a pair of edges and a convex curved surface therebetween.

9. The head support sleep aid set forth in claim 8 wherein said earpiece and said pillow are formed of a soft resilient foam material.

10. The head support sleep aid set forth in claim 9 wherein said soft resilient foam material includes foam plastic.

11. The head support sleep aid set, forth in claim 9 wherein said soft resilient foam material includes foam rubber.

* * * * *